US011784021B2

(12) United States Patent
Shi et al.

(10) Patent No.: US 11,784,021 B2
(45) Date of Patent: Oct. 10, 2023

(54) MECHANICAL BREAKING AND FUSING COMBINED MULTI-FRACTURE EXCITATION FUSE

(71) Applicant: XI' AN SINOFUSE ELECTRIC CO., LTD., Xi'an (CN)

(72) Inventors: Xiaoguang Shi, Xi'an (CN); Rongrong Chen, Xi'an (CN); Wei Wang, Xi'an (CN)

(73) Assignee: XI' AN SINOFUSE ELECTRIC CO., LTD., Xi'an (CN)

( * ) Notice: Subject to any disclaimer, the term of this patent is extended or adjusted under 35 U.S.C. 154(b) by 169 days.

(21) Appl. No.: 17/430,270

(22) PCT Filed: May 12, 2021

(86) PCT No.: PCT/CN2021/093433
§ 371 (c)(1),
(2) Date: Aug. 11, 2021

(87) PCT Pub. No.: WO2022/121232
PCT Pub. Date: Jun. 16, 2022

(65) Prior Publication Data
US 2022/0189723 A1 Jun. 16, 2022

(51) Int. Cl.
*H01H 39/00* (2006.01)
*H01H 71/14* (2006.01)
(Continued)

(52) U.S. Cl.
CPC ..... *H01H 71/14* (2013.01); *H01H 39/00* (2013.01); *H01H 85/08* (2013.01); *H01H 85/38* (2013.01); *H01H 2071/147* (2013.01)

(58) Field of Classification Search
CPC ..... H01H 39/00; H01H 39/006; H01H 2039/008; H01H 71/14; H01H 2071/147;
(Continued)

(56) References Cited

U.S. PATENT DOCUMENTS

2010/0218659 A1* 9/2010 Ukon ..... B23D 15/145 83/639.1
2013/0255463 A1* 10/2013 Ukon ..... H01H 39/006 83/639.1
(Continued)

FOREIGN PATENT DOCUMENTS

AT 521150 B1 11/2019
CN 102891047 A 1/2013
(Continued)

OTHER PUBLICATIONS

Tung Chao, Electronically Controlled Current Limiting Fuses, 1995 IEEE , pp. 205-222.
(Continued)

*Primary Examiner* — Jacob R Crum
(74) *Attorney, Agent, or Firm* — IP & T GROUP LLP

(57) ABSTRACT

A mechanical breaking and fusing combined multi-fracture excitation fuse includes a shell, wherein a cavity is formed in the shell, and at least one conductor penetrates through the shell and penetrates through the cavity; at least one excitation device and one breaking device are arranged in the cavity of the shell; the excitation device can receive an external excitation signal to drive the breaking device to act to break a conductor corresponding thereof to form at least two fractures on the conductor, at least one fuse is connected in parallel onto the conductor. The melt is connected in parallel with at least one fracture, and the melt is connected in series with at least one fracture.

20 Claims, 10 Drawing Sheets

(51) Int. Cl.
*H01H 85/08* (2006.01)
*H01H 85/38* (2006.01)

(58) Field of Classification Search
CPC ..... H01H 85/08; H01H 85/10; H01H 85/12; H01H 85/38
See application file for complete search history.

(56) References Cited

U.S. PATENT DOCUMENTS

| | | | | |
|---|---|---|---|---|
| 2013/0263714 | A1* | 10/2013 | Ukon | B23D 35/002 83/639.1 |
| 2014/0326122 | A1* | 11/2014 | Ukon | B23D 15/145 83/468.1 |
| 2015/0348731 | A1 | 12/2015 | Douglass et al. | |
| 2016/0351363 | A1 | 12/2016 | Gaudinat et al. | |
| 2018/0277325 | A1* | 9/2018 | De Palma | H01H 71/1045 |
| 2020/0211804 | A1* | 7/2020 | Wang | H02H 3/05 |
| 2020/0279711 | A1* | 9/2020 | Mathieu | H01H 85/0039 |
| 2020/0321181 | A1* | 10/2020 | Mathieu | H01H 39/004 |
| 2021/0183607 | A1* | 6/2021 | Schlaak | H01H 39/006 |
| 2022/0246377 | A1* | 8/2022 | Gerlaud | H01H 9/106 |

FOREIGN PATENT DOCUMENTS

| | | | |
|---|---|---|---|
| CN | 106531553 | A | 3/2017 |
| CN | 106876216 | A | 6/2017 |
| CN | 110797835 | A | 2/2020 |
| CN | 110854000 | A | 2/2020 |
| CN | 211980553 | U | 11/2020 |
| CN | 212625470 | U | 2/2021 |
| CN | 112447462 | A | 3/2021 |
| CN | 112447464 | A | 3/2021 |
| DE | 80 27 885.9 | U1 | 12/1981 |
| EP | 0 895 646 | A1 | 11/1997 |
| EP | 3 244 429 | A1 | 11/2017 |
| FR | 3 051281 | A1 | 11/2017 |
| FR | 3 071659 | A1 | 3/2019 |
| FR | 3 081255 | A1 | 11/2019 |
| GB | 788208 | A | 12/1957 |
| JP | 2017-54774 | A | 3/2017 |
| JP | 2020-184541 | A | 11/2020 |
| KR | 10-2009-0130818 | A | 12/2009 |
| KR | 10-1919557 | B1 | 11/2018 |
| RU | 2 219 611 | C2 | 12/2003 |
| WO | 2020/071218 | A1 | 4/2020 |
| WO | 2020204154 | A1 | 10/2020 |

OTHER PUBLICATIONS

International Search Report for International Patent Application No. PCT/CN2021/093433 issued by the Chinese Patent Office dated Aug. 11, 2021.

Notice of Reasons for Refusal for Japanese Patent Application No. 2021-549197 issued by the Japanese Patent Office dated Mar. 9, 2023.

Request for the Submission of an Opinion for Korean Patent Application No. 10-2021-7024274 issued by the Korean Patent Office dated Feb. 23, 2023.

European Search Report for Application No. 21745880.1 issued by the European patent Office dated Jul. 1, 2022.

First Office Action for European Patent Application No. 21745880.1 issued on by the European Patent Office dated Jul. 13, 2022.

Second Office Action for European Patent Application No. 21745880.1 issued on by the European Patent Office dated Feb. 9, 2023.

European Search report for European Patent Application No. 21745880.1 issued on by the European Patent Office dated Mar. 21, 2022.

Written Opinion of the International Searching Authority for International Application No. PCT/CN2021/093433 issued by the Chinese Patent Office dated Aug. 5, 2021.

* cited by examiner

MECHANICAL BREAKING AND FUSING COMBINED MULTI-FRACTURE EXCITATION FUSE

CROSS-REFERENCE TO RELATED APPLICATION

This application is a National Phase application of PCT application no. PCT/CN2021/093433 filed on May 12, 2021, which claims priority of Chinese patent application with the filing number 202011458693.0 filed on Dec. 11, 2020 with the Chinese Patent Office, and entitled "Mechanical breaking and fusing combined multi-fracture excitation fuse", the contents of which are incorporated herein by reference in entirety.

TECHNICAL FIELD

The present disclosure relates to the fields of power protection, control, and electric vehicles, in particular to a fuse for controlling and cutting off a current transmission circuit through an external signal.

BACKGROUND ART

The fuse used for circuit overcurrent protection is fused based on the heat generated by the current flowing through the fuse, the existing main problem is that it is restricted by the following working principle: because the heat generated by the continuous flowing of a certain amplitude of current causes the melt inside the fuse to heat up and reach the melting temperature or vaporization temperature, the melt is fused to form a fracture. If the current value is not large enough or the duration is not long enough, the temperature of the melt cannot reach the melting point, the melt cannot be fused to be broken, and the circuit cannot be cut off, but a certain degree of high temperature will occur. If the fuse has good protection performance and fast fusing speed, the fuse needs to have a large heating power and concentrate the heating position on the local part of the melt. Some other characteristics required by the working conditions of the fuse comprise that the fuse should have low temperature rise value and low power consumption during operation, and should not be damaged when withstanding the cycle of a larger amplitude short-time overload/impulse current (such as the short-time large current when an electric vehicle starts or climbs), which require the fuse to have a relatively small heating power, and the heating position is not concentrated in the local part of the melt. Under different working conditions, the requirements for the current-flowing and heating of the melt are opposite, wherein if the heating power is reduced or the degree of concentration of the melt current heating distribution is reduced, the fuse cannot break a certain amplitude of fault current at a sufficiently fast breaking speed; and conversely, if the fault current with a certain amplitude can be broken at a sufficiently fast breaking speed to increase the thermal power of the fuse and the degree of concentration of the melt heat distribution, it is difficult to carry a higher working current and has a higher temperature rise and power consumption, or it is difficult to withstand the cyclic impact of a larger overload/impulse current without being damaged, and it requires better heat dissipation conditions, larger volume and higher cost. For example, in the main circuit of a new energy vehicle, if there is a low-amplitude overload or short-circuit current, a traditional fuse with a small rated current specification cannot meet the requirements of normal load current and non-breaking due to excessive current for a short time, and if the traditional fuse with a large rated current specification is selected, it cannot meet the requirement of a sufficiently fast breaking speed. When the battery pack of a new energy vehicle is low in power, the output current amplitude is not large during short circuit, wherein if the fuse cannot be fused to be broken quickly in time, it may cause the arc at the short-circuit point to last too long, which may cause fire burning, or the battery pack may continue to heat up due to excessive current and cause damage or fire-burning.

In addition, the fuse based on hot-melt principle cannot communicate with the external equipment, and cannot be triggered by other signals except the current, and cannot cut off the circuit to achieve protection, if the vehicle is in a serious collision, soaking in water, or the battery temperature is too high after exposure to the sun and the like.

At present, there is a triggerable switch structure for quickly breaking the circuit on the market, which mainly includes a gas generating device and a conductive terminal, the gas generating device generates high-pressure gas to drive the piston to break the conductive terminal to achieve the purpose of quickly disconnecting the circuit. However, there are some serious shortcomings and defects: the current flowing through the fracture arcs in the air, it is difficult to extinguish a large-amplitude fault current arc, or a large space is required; air is used to cool and break the arc, and its extinguishing is greatly affected by air pressure, temperature and humidity, air impurities and the like, and its reliability is not good; during the breaking process, the arc directly burns the piston head, and the burning damage will affect the smooth arc extinguishing; and if the large-amplitude current arc is extinguished by air in a small-volume space, the insulation resistance after disconnection is also relatively low.

SUMMARY

The technical problem to be solved by the present disclosure is to provide a fuse that breaks a conductor through combination of fusing and mechanical force, and the fuse is made to be connected in parallel to some fractures and under certain conditions, be connected in series with some fractures, by utilizing the ability of the fuse reliably breaking large-amplitude current and through integrated design, so that the fuse is connected in parallel with the conductor to reduce the temperature rise and power consumption in a non-breaking state and improve the resistance to current impact, wherein the fuse only needs a small current-carrying ability. When a breaking action is required, the fuse greatly reduces, by making an exciter and a breaking device break a portion of the conductor, the arc energy of the fracture connected in parallel therewith, protects the parallelly-connected fractures to safely restore the insulation dielectric performance under large current, and the fuse is connected in series to some fractures, so that the energy value of arc passing through the serially-connected fractures is limited to protect the fractures to safely break a certain amplitude of overcurrent without the exceeding a safety limit; and utilizing the linkage of breaking device can control the sequence of the breaking actions (i.e. forming sequence of the fractures), and the fuse can be flexibly used to protect the serially-connected fractures and parallelly-connected fractures, improving the ability of breaking large-amplitude overcurrent and enabling rapidly breaking of amplitude overcurrent of small current, thus realizing fast and reliable breaking of all overcurrent from zero to maximum breaking capability, greatly reducing volume and saving costs.

In order to solve the above technical problems, the technical solution provided by the present disclosure is a mechanical breaking and fusing combined multi-fracture excitation fuse, comprising a shell, wherein a cavity is formed in the shell, and at least one conductor penetrates through the shell and passes through the cavity; at least one excitation device and at least one breaking device are arranged in the cavity of the shell; the excitation device can receive an external excitation signal to drive the breaking device to act to break a conductor corresponding thereof and form at least two fractures on the conductor, at least one melt is arranged in parallel on the conductor. The melt is connected in parallel with at least one fracture, and the melt is connected in series with at least one fracture. The existence of the serially-connected fracture ensures that the circuit can be disconnected through the serially-connected fractures when the melt cannot be fused to be broken.

An arc extinguishing chamber filled with an arc extinguishing medium is provided in the shell; the melt is inserted in the arc extinguishing chamber with a part or whole of the melt located in the arc extinguishing chamber; a fused fracture of the melt is located in the arc extinguishing chamber, and the arc extinguishing medium is helpful for arc extinguishing.

Preferably, the fracture connected in parallel with the melt is broken first, and the fracture connected in series with the melt is broken afterwards.

At least two adjacent cavities are formed in the shell, the conductor penetrates through the shell and penetrates through the adjacent cavities, each of cavities at one side of the conductor are provided therein with an excitation device and a breaking device, wherein the excitation devices and the breaking devices in different cavities are located at the same side or different sides of the conductor, each of the breaking devices is provided with at least one impact head, the excitation device is capable of receiving an external excitation signal to drive the corresponding breaking device to break the conductor for forming at least one fracture. Its purpose is to control the forming sequence of fractures on the conductor through the sequence of receiving the excitation signals from different excitation devices.

The breaking device is provided with at least two impact heads at intervals, wherein each impact head is configured to create at least one fracture on the conductor.

The distances between the impact heads and the conductor are different, the impact head with the shortest distance to the conductor first creates the fracture on the conductor, and the melt is connected in parallel at the fracture which is formed first. Its purpose is to control the forming sequence of the fractures of the conductor through the different distances from the impact heads of the breaking device to the conductor.

The excitation device is a gas generating device, the breaking device is a piston, and the contact of the breaking device and the cavity is sealed contact or contact with a gap of less than 0.1 mm, as long as it is ensured that high-pressure gas generated by the excitation device can drive the breaking device to break the conductor.

A limiting structure for maintaining the breaking device at an initial position is arranged between the breaking device and the cavity.

The conductor corresponding to the breaking device is provided with a weak to-be-broken portion that reduces the strength of the conductor, wherein the fracture is formed by breaking the weak to-be-broken portion. The weak portion to-be-broken comprises a reduced section structure provided at the conductor, a structure of increasing the stress at the fracture of the conductor, and/or a material with low mechanical strength used at the fracture of the conductor. The reduced section structure is one of gap(s) provided at one side or two sides of the conductor, U-shaped groove(s) and/or V-shaped groove(s) provided at one side or two sides of the conductor and crossing the width of the conductor, and hole(s) provided at the conductor, or combination of more of them.

The melt is provided with a weak to-be-fused portion, and the melt is fused to be broken at the weak to-be-fused portion. The weak to-be-fused portion comprises a variable section structure and/or a narrow path provided on the melt, and/or a conductor material capable of being melted at a low temperature, and/or a conductor material with different conductivity used at the melt. By setting the weak to-be-broken portion with low mechanical strength of the conductor and setting on the melt the weak to-be-fused portion for fusing, the breaking speed of the conductor and the melt can be accelerated.

The melt is extended to bypass at least one serially-connected fracture and then connected to the parallelly-connected fracture to form an electromagnetic field that interacts with an electromagnetic field generated by the conductor, to elongate the arc path obtained after the conductor fracture is formed.

An impact end of the impact head is in a constricted surface structure, a pointed protruding structure, an inclined surface structure or a concave structure having two sides being tips.

The support device is arranged between the weak to-be-broken portions.

The excitation fuse of the present disclosure is applicable to a distribution power supply, energy storage equipment, electrical equipment or vehicles.

The fuse of the present disclosure is designed to have three working states: 1. the breaking device does not act, the conductor has no fracture, the main current flows through the conductor, and a small current flows through the melt to achieve reliable low-power-consumption operation, which requires a very small rated current, typically 10 to 30 amperes; 2. the breaking device breaks the conductor, preferentially breaks portions of the conductor connected in parallel with the melt, to form fractures, wherein when a large current passes through the unbroken portions of the conductor and the melt, the melt is fused to be broken, the energy of the arc occurring at the conductor fractures is very small, most of the arc flows through the melt, the melt is fused and arc-extinguished, the insulation dielectric performance is quickly restored, and the typical value is 100 us level; 3. the breaking device breaks the portions of the conductor not connected in parallel with the melt, to form fractures, and the typical value is ms level, the zero current and smaller amplitude current can be broken, and because the arc generated is smaller, the arc can be extinguished directly by air without the aid of melt.

The excitation device is preferably a gas generating device, an electric current is used to stimulate a chemical reaction to release chemical energy, similar to that gunpower is combusted to release energy and pressure gas, the pressure gas can be excited in less than 1 ms, which is relatively fast. Preferably, the breaking device operating with the pressure gas is a piston.

BRIEF DESCRIPTION OF DRAWINGS

In order to illustrate the technical solutions of the present disclosure more clearly, the drawings that need to be used therein will be briefly introduced below, it should be understood that the following drawings only show some embodiments of the present disclosure, and therefore should not be regarded as a limitation of the scope, and for those ordinarily skilled in the art, other relevant drawings can also be obtained in light of these drawings, without using any inventive efforts.

DETAILED DESCRIPTION OF EMBODIMENTS

Figure 1:
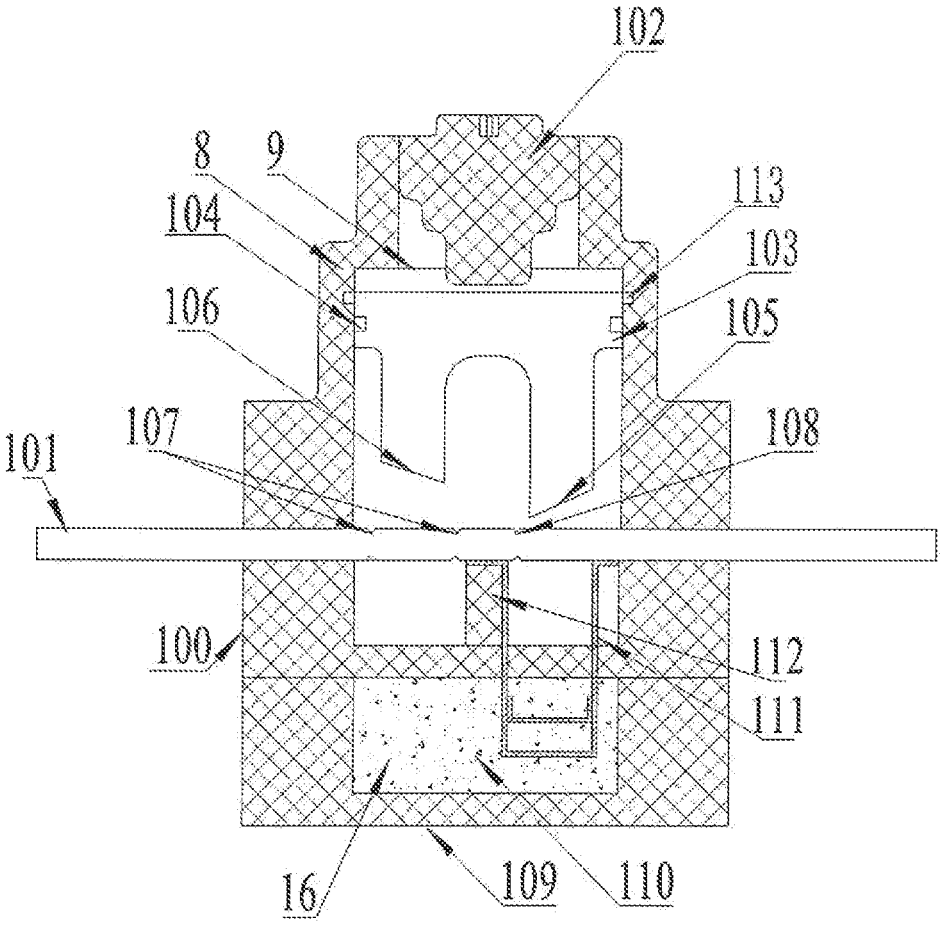
FIG. 1 is a structural schematic view of a front longitudinal section of a fuse in the present disclosure.
Figure 2:
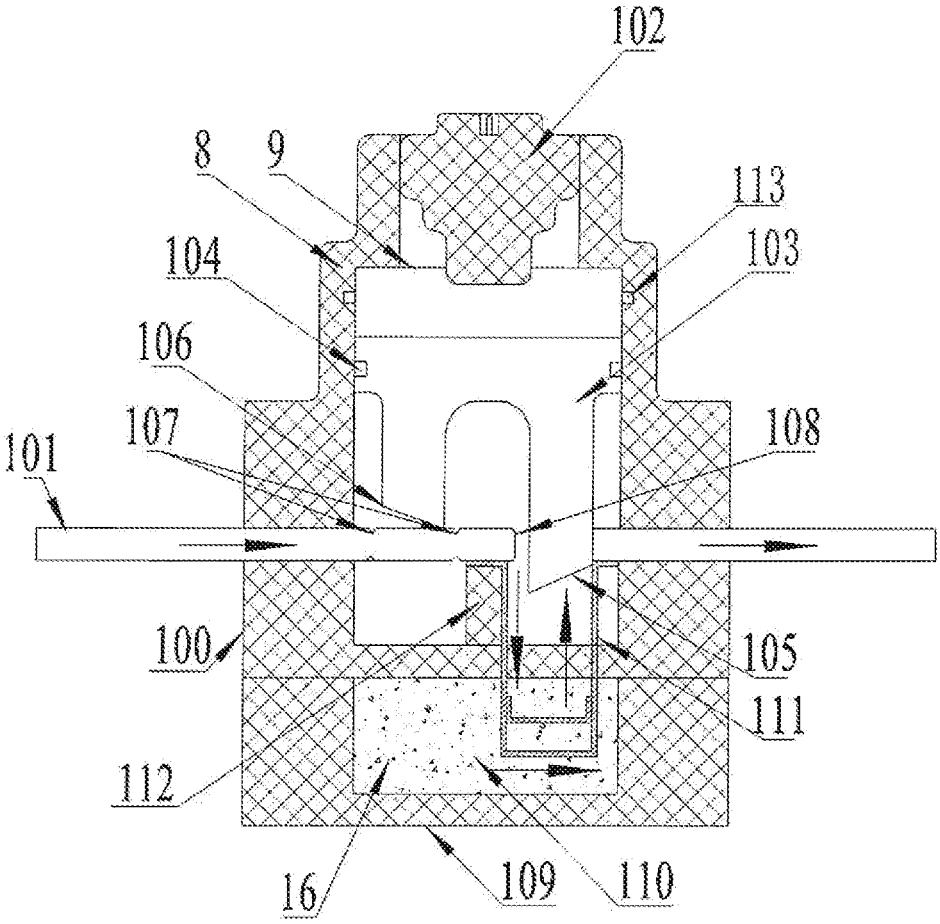
FIG. 2 is a structural schematic view of a front longitudinal section of the fuse in the present disclosure.
Figure 3:
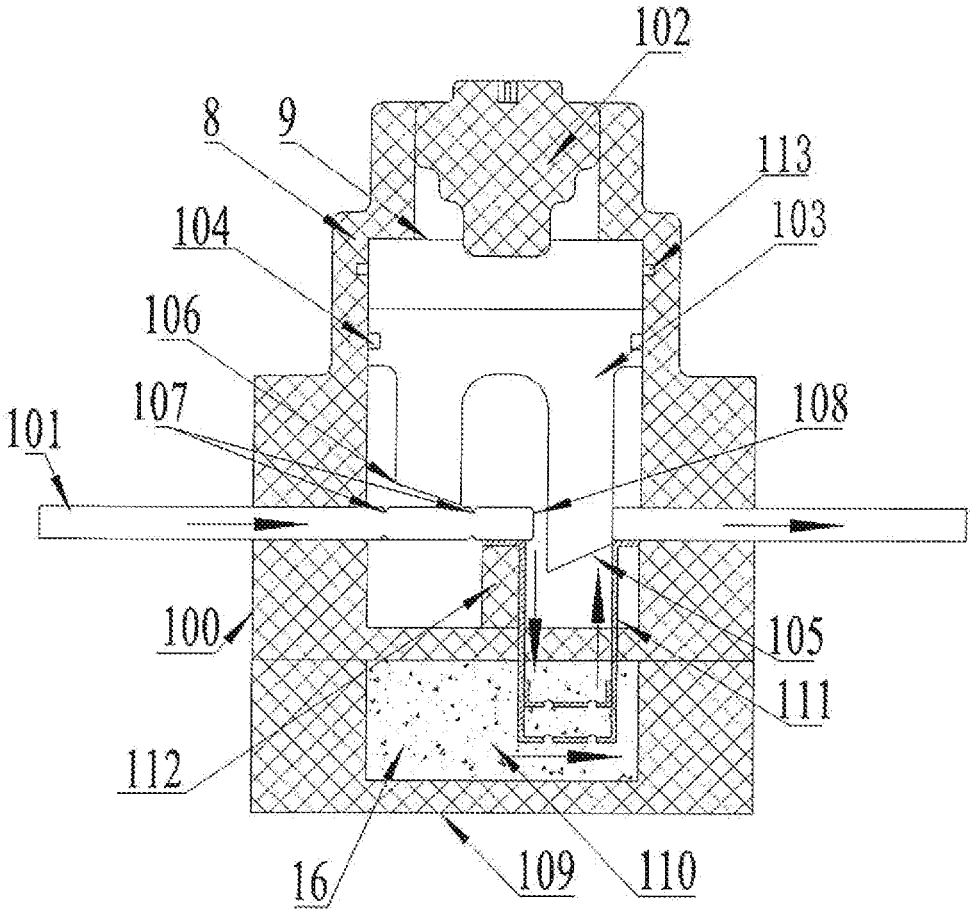
FIG. 3 is a structural schematic view of a front longitudinal section of the fuse in the present disclosure.
Figure 4:
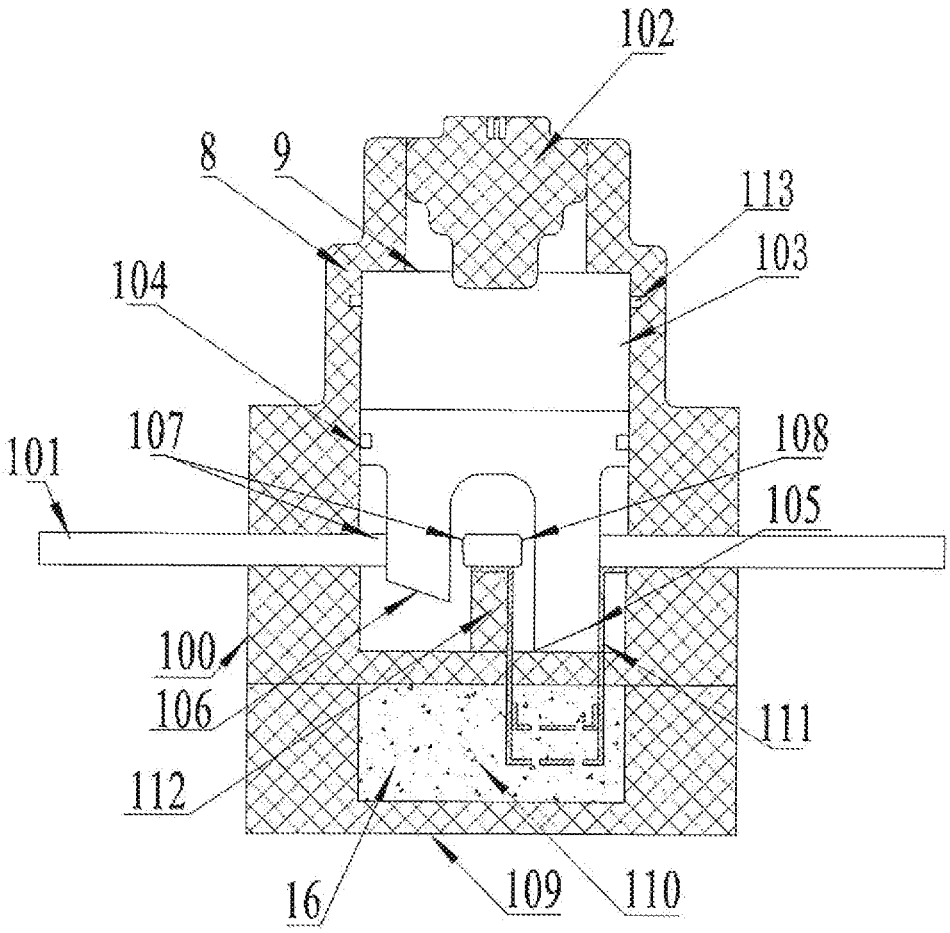
FIG. 4 is a structural schematic view of a front longitudinal section of the fuse in the present disclosure.

Hereinafter, the embodiments will be described in detail with reference to the drawings. As shown in FIG. 1 to FIG. 7, the excitation fuse (also referred to a trigger fuse) of the present disclosure mainly includes a shell 100, a conductor 101, an excitation device (also referred to as a trigger device) 102, and a breaking device 103.

The shell 100 has a mold cavity penetrating through the upper end of the shell 100. The conductor 101 is inserted into the shell 100, and the conductor 101 passes through the mold cavity provided in the shell 100 to divide the mold cavity into two parts. The two ends of the conductor 101 extend out of the shell 100 and can be connected to an external circuit. The conductor 101 can also be arranged inside the shell 100, and has two ends connected respectively with conductive terminals which are arranged at two ends of the shell 100 and extend out of outside of the shell 100, and are connected to an external circuit through the conductive terminals. The conductor 101 can be in a plate-shaped structure, or of any cross-sectional shape, such as the conductor 101 of a round shape, square shape, special shape, tubular shape and the like, or a combination of the shapes. In the following description, the plate-shaped structure is taken as an example for description. The shell 100 may be provided therein with one conductor 101 or several conductors arranged in parallel. The shell of an upper-lower structure is taken as an example for description in the disclosure, wherein the shell 100 can be in a left-right combination, and is not limited to the upper-lower combination.

In the mold cavity above the conductor 101, the excitation device 102 and the breaking device 103 are sequentially arranged from top to bottom. The excitation device 102 is fixedly arranged at the top of the cavity, and is restricted by a limit step arranged in the mold cavity, and the upper portion thereof is fixed by a pressing plate or a pressing sleeve (not shown in the drawings). The excitation device 102 is a gas generating device in the present embodiment, which can receive an excitation signal from outside when fault occurs and perform ignition and detonation to generate a high-pressure gas to form a driving force and drive the breaking device 103 to act. The excitation device 102 may also be a mechanical structure device that can receive external excitation signals, such as an air cylinder, a hydraulic cylinder, a motors, etc., and provide driving force to the breaking device 103 by receiving external signals.

Figure 10:
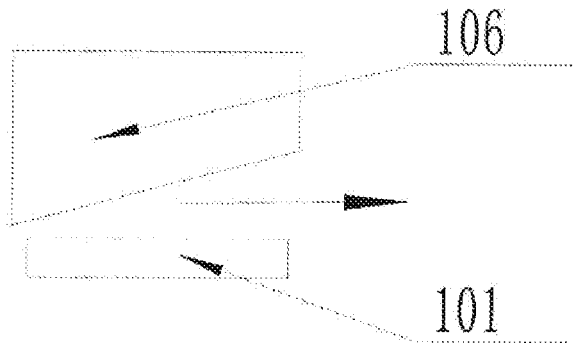
FIG. 10 is a structural schematic view of an impact head of the present disclosure.
Figure 11:
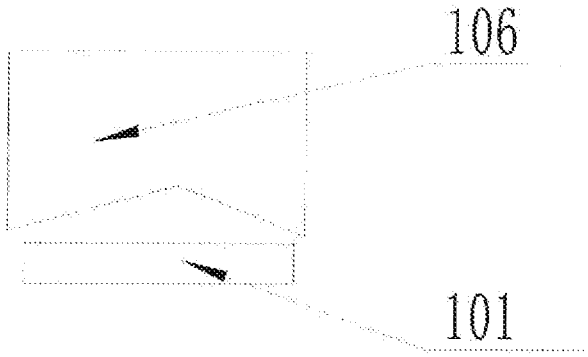
FIG. 11 is a structural schematic view of an impact head of the present disclosure.

The breaking device 103 is arranged in the mold cavity between the excitation device 102 and the conductor 101, and a certain distance is kept between the conductor 101 and the impact ends of the breaking device 103, which ensures the impact force of the breaking device 103. Of course, the breaking device 103 can also be directly arranged on the conductor 101 as long as it is ensured that the conductor 101 can be broken off. When the excitation device 102 is a gas generating device, the contact surfaces of the breaking device 103 and the mold cavity are sealed or have a small gap that does not affect the driving force therebetween, to ensure that when the excitation device 102 is a gas generating device, all the driving force generated act on the breaking device 103 without leakage, so as to avoid insufficient driving force. The sealing member 104 is provided between the breaking device 103 and the mold cavity to achieve the sealed contact, or an interference fit can also be used to achieve the sealed contact. When the breaking device 103 is not driven by the driving force and located at the initial position, a limiting structure 113 is provided at the contact surface of the breaking device 103 in contact with the mold cavity to ensure that the breaking device 103 is fixed at the initial position and will not displace in the mold cavity to cause misoperation. The limiting structure 113 may comprise small bumps arranged at intervals on the outer circumference of the breaking device 103, and the inner wall of the mold cavity is correspondingly provided with grooves, wherein the bumps of the breaking device 103 are clamped into the grooves to realize the position limitation. When the breaking device 103 experiences the driving force from the excitation device 102, the limiting structure 113 can be broken under impact to release the effect of position limitation. At least two impact heads (in the present disclosure, two impact heads 105, 106) with different heights are arranged at intervals in the length direction of the conductor 101 under the breaking device 103. The impact ends of the impact heads 105, 106, that is, the structures of the ends of the impact heads 105, 106 configured to cut off the conductor 101, can be a structure with a gradually reduced section, or a pointed protruding structure as shown in FIG. 10, or a structure as shown in FIG. 11 in which the end faces of the impact heads 105, 106 each have a concave center portion and two sides of pointed protruding structures, or other structures that are beneficial to break the conductor 101. For example: the constricted surface structure is a convex arc-shaped structure, and the pointed protruding structure is a knife-edge structure, an inclined surface sharp angle structure, and a tapered sharp angle structure. The breaking device 103 is a structure which can be driven by the excitation device 102, such as a piston, a slider, and the like. When the excitation device 102 is a gas generating device and drives by the generated high-pressure gas the breaking device 103 to move, it can be ensured that the generated high-pressure gas allows the breaking device 103 to be driven to move to cut off the conductor 101, because the contact surfaces of the breaking device 103 and the inner mold cavity of the shell 100 are in sealed contact or have a small gap contact with the gap being less than 0.1 mm. For the breaking device 103 with dimensions of millimeter level or greater, a gap of 0.1 mm or less is reserved, so as to leak less gas to the extent of not affecting the movement of the breaking device 103 and obtaining a good driving force; although a greater driving force is obtained through the sealing of the contact surfaces of the breaking device 103 and the mold cavity, the frictional force suffered by the breaking device 103 is generally larger in this case. Therefore, the sealing method is determined according to the driving force of the high-pressure gas generated by the gas generating device. The sealed contact can be achieved by providing a sealing member 104 between the breaking device 103 and the mold cavity, or interference fit can be used to achieve sealed contact. When the excitation device 102 is a device such as a cylinder or a hydraulic cylinder that can receive external excitation signals to act for providing driving force, the contact between the breaking device 103 and the mold cavity does not need to be the sealed contact.

At one side of the conductor 101 located below the impact heads 105, 106 of the breaking device 103, a plurality of spaced weak to-be-broken portions 107, 108 are respectively provided at positions corresponding to the impact heads 105, 106. In the present embodiment, the weak to-be-broken portions 107, 108 are arranged on one side of the conductor 101 below the impact heads of the breaking device 103 and at the positions corresponding to the position of the corresponding impact heads. Two weak to-be-broken portions 107 corresponding to the impact head 106 are arranged at intervals, one weak to-be-broken portion 108 corresponding to the impact head 105 is arranged, a support device 112 is provided between the weak to-be-broken portion 107 and the weak to-be-broken portion 108 to support the conductor 101, wherein when the support device 112 is located under the conductor 101, the support device 112 may be a supporting boss; when the support device 112 is located at the side of the conductor 101, the support device 112 may be a fixed support arm; and the support device 112 may be also located above the conductor 101 to play a supporting role by allowing the conductor 101 to penetrate therethrough. Next, the working principle of the excitation fuse of the present disclosure will be explained with reference to FIG. 1 to FIG. 7. When the conductor 101 is impacted by the impact heads of the breaking device 103, the impact head 105 first breaks the weak to-be-broken portion 108 of the conductor 101 to form a fracture on the conductor 101, and as the impact head continues to move, the impact head 105 causes increase of the distance between two sides of the fracture at the weak to-be-broken portion; as the breaking device 103 continues to move down, the impact head 106 breaks the two weak to-be-broken portions 107 on the conductor 101, to form fractures at the two weak to-be-broken portions 107 respectively. Each of portions of the broken conductor 101 continues to be displaced under the forcing of the impact heads, so that the sizes of the fractures generated at the three weak to-be-broken portions are continuously increased. In the present embodiment, through two impact heads of the breaking device 103, the fracture at the weak to-be-broken portion 108 and the fractures at the weak to-be-broken portions 107 are successively generated. Of course, the distances between the impact heads 105, 106 of the breaking device 103 and the conductor 101 can be the same, so the three fractures at the weak to-be-broken portions are formed at the same time. In FIG. 1 to FIG. 7, two fractures are formed on the horizontally arranged conductor 101 by one impact head 106, and the conductor can also be provided to be in a bent or inclined state, and two weak to-be-broken portions are provided thereon at intervals, so that the impact head can first break off one weak to-be-broken portion to form a facture with the weak to-be-broken portion being in earliest contact with the impact head, and then break off another weak to-be-broken portion to form a fracture.

An arc extinguishing shell 109 is further provided under the shell 100, the arc extinguishing shell 109 is provided with the mold cavity, the mold cavity is filled with the arc extinguishing medium 110. Referring to FIG. 1 to FIG. 7, two melts 111 are inserted in the arc extinguishing medium, and the weak to-be-fused portions of the melts 111 are located in the arc extinguishing medium. The weak to-be-fused portion of the melt 111 can be a narrow path, a variable section structure, or a material with different conductivity lapped on the melt 111, which can change heating performance through the change of the resistance, accelerating the fusing; or may also be a low-temperature fusing material (lower than the melting point of the melt 111 itself) lapped on the melt 111 to accelerate the fusing speed. After passing upward through the arc extinguishing shell 109 and the shell wall of the shell 100, the two ends of the melt 111 are respectively connected in parallel with portions of the conductor 101 located at two sides of the weak to-be-broken portion 108, and are configured to be connected, on the conductor 101, in parallel with the weak to-be-broken portion 108 where a fracture is formed and in series with the two weak to-be-broken portions 107 where two fractures are formed. When there are multiple fractures formed on the conductor 101, it is necessary to ensure that the melt 111 is at least connected in parallel with one fracture and in series with one fracture. The melt 111 connected in parallel with the fracture can be in number of one or more.

Figure 5:
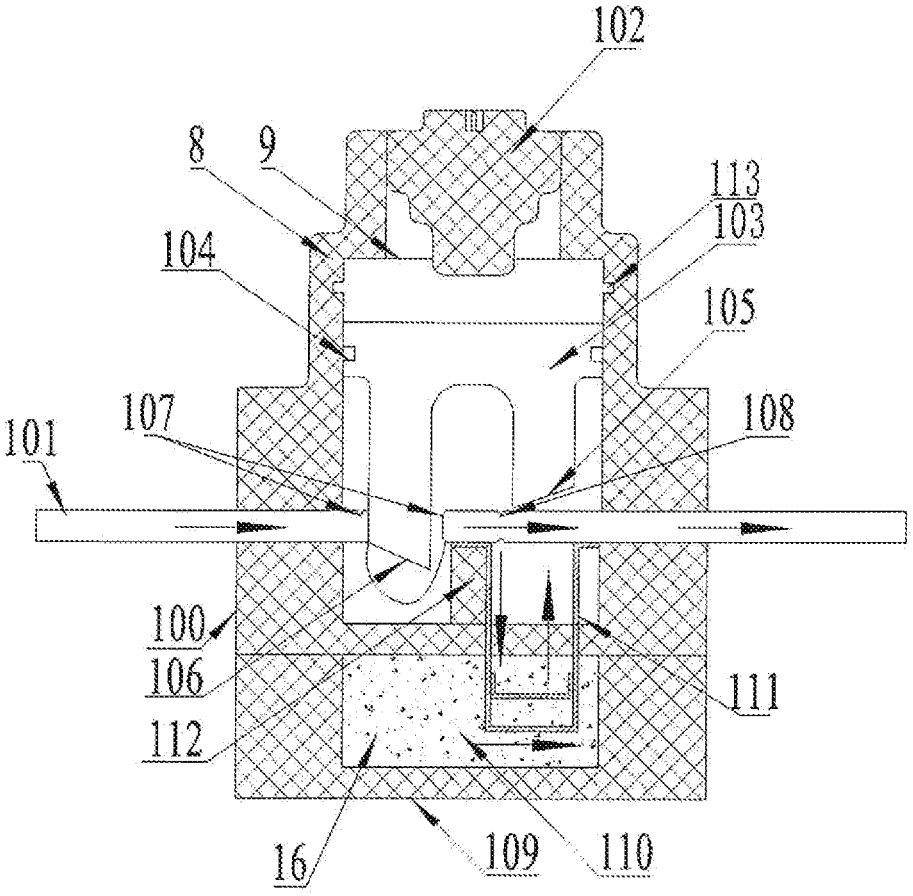
FIG. 5 is a structural schematic view of a front longitudinal section of the fuse in the present disclosure.
Figure 6:
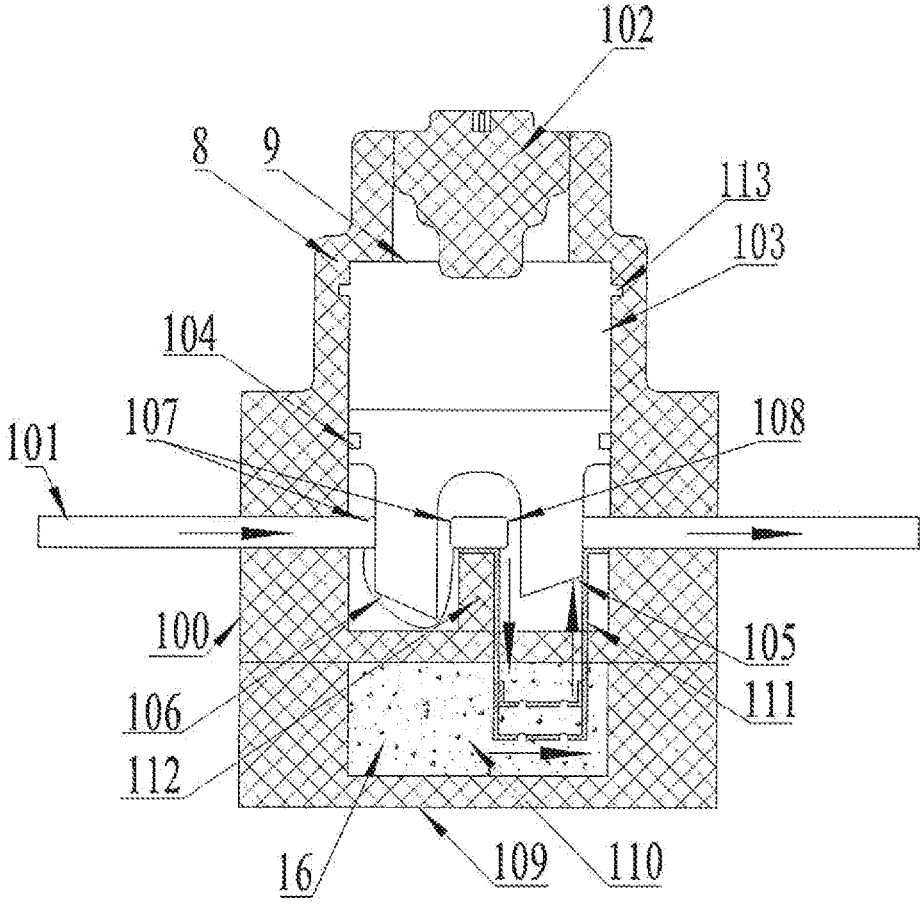
FIG. 6 is a structural schematic view of a front longitudinal section of the fuse in the present disclosure.
Figure 7:
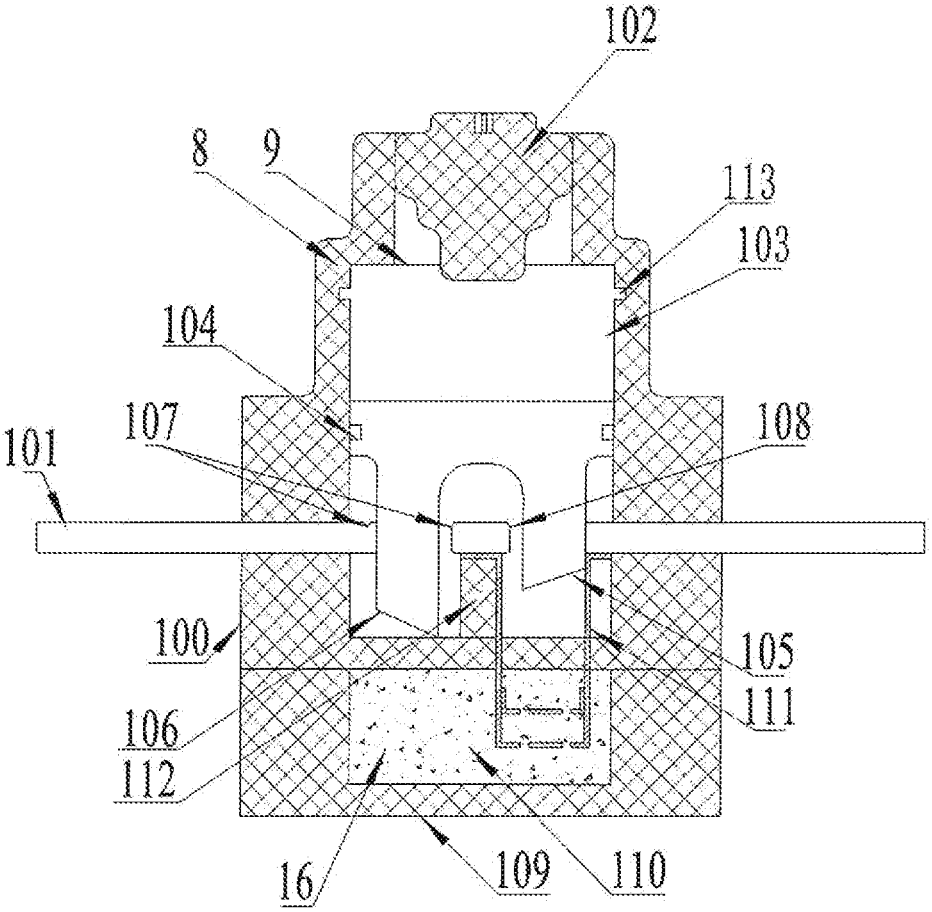
FIG. 7 is a structural schematic view of a front longitudinal section of the fuse in the present disclosure.

The melt 111 connected in parallel with the fracture is beneficial to the recovery of the insulating medium at the fracture. After the fracture is formed, since the resistance at the fracture gradually increases and is much larger than resistance of the melt 111, therefore, the overcurrent is transferred from the state of mainly flowing through the conductor 101 to the state of mainly flowing through the melt 111, so that the energy is mainly discharged from the melt 111, wherein the energy of the overcurrent flowing through the melt 111 can reach more than 70%, and only a small amount of energy flows through the fracture, resulting in that generated arc is smaller (less insulting medium breakdown at the fracture), achieving quick arc extinguishing and restoring the insulation performance at the fracture. As shown in FIG. 1 to FIG. 4, for improving the breaking capability of large amplitude current, it is better to firstly break the weak to-be-broken portion of the conductor 101 connected in parallel with the melt, and then break after delaying for a certain time the weak to-be-broken portion connected in series with the melt 111. After a fracture connected in parallel with the melt 111 is generated, another weak to-be-broken portion connected in series with the melt 111 is delayed to be broken, most of the overcurrent flows through the unbroken portions of the conductor 101 and the melt 111, and after a certain period of time, the weak to-be-broken portion connected in series with melt 111 is broken after the delaying. If the overcurrent of a larger amplitude is to be broken at this time, the melt 111 may have been fused to be broken within the delay time interval of the two fractures, and at this time, the weak to-be-broken portion connected in series with the melt 111 is broken, and there is no much current at the fracture; even if the melt 111 have not been broken by fusing, large-amplitude current has passed through the melt 111 within the delay time interval, and the melt 111 has been heated, the melt 111 will also be broken by fusing within a short time after the weak to-be-broken portion connected in series is broken, the current energy passing through the serially-connected fracture is limited by the melt 111, which can avoid serious damage to the serially-connected fracture caused by the large-amplitude current. If the overcurrent of a small amplitude is broken, the serially-connected fracture breaks the current, and the melt 111 does not act due to less flow energy. Taking FIG. 1 to FIG. 4 as an example, when a large current is broken, the fracture of the serially-connected weak to-be-broken portion 107 is connected in series with the fused fracture of the melt 111, wherein when breaking a large-amplitude overcurrent, the fuse can be fused to be broken before the serially-connected fracture occurs, or fused to be broken soon after the serially-connected fracture occurs, so that the serially-connected fracture does not break the large-amplitude current separately, and when breaking a small-amplitude overcurrent, the fuse is not broken by fusing, and the serially-connected fracture only needs to cut off the small-amplitude overcurrent. Therefore, the fracture connected in parallel with the melt 111 will shunt energy due to the melt 111, the serially-connected fracture breaks the large-amplitude current due to the fuse, and limits the flowing time and energy of the large-amplitude current, the two fractures are well protected by the melt 111, and both of them only need to break the current of smaller amplitude. In addition, as shown in FIG. 5 to FIG. 7, the serially-connected fracture with stronger arc energy resistance can also be formed first, and then the parallelly-connected fracture can appear later, wherein the fracture connected in series with the melt 111 is formed first, enabling a limiting effect on the current amplitude and reducing the amplitude of the current broken by another fracture.

The arc extinguishing shell 109 may be formed separately, or may be an integral structure with the shell 100. In FIG. 1 to FIG. 7, by arranging impact heads of different heights on the breaking device 103, a plurality of fractures are formed on the conductor 101 successively. Multiple sets of excitation devices and breaking devices may also be provided, and multiple fractures can be form successively on the conductor based on the sequence of receiving excitation signals by different excitation devices.

Figure 8:
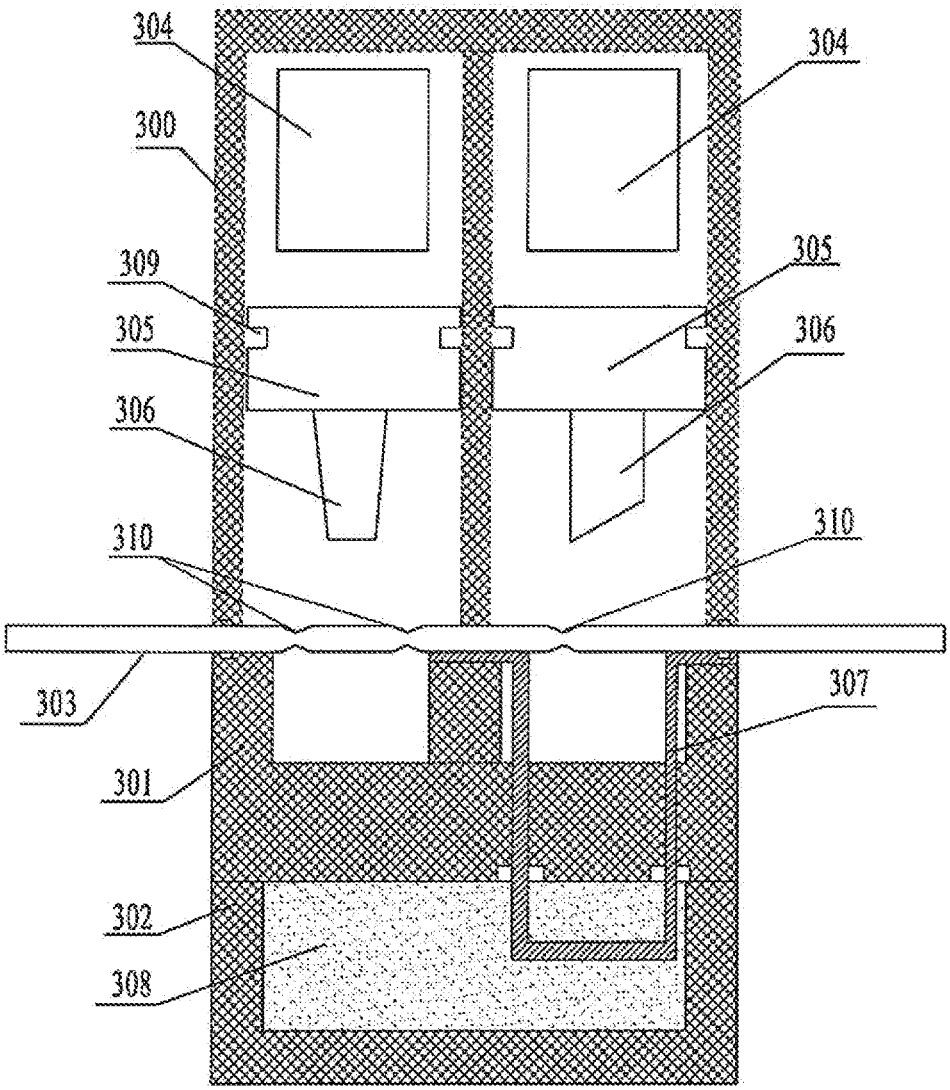
FIG. 8 is a structural schematic view of an optional longitudinal section in the present disclosure.

FIG. 8 is a structural schematic view of two sets of excitation devices and breaking devices. The shell is composed of an upper shell 300, a lower shell 301, and an arc extinguishing shell 302, and the contact surfaces of the shells are in sealed contact. Two adjacent sets of cavities are provided in the upper shell 300 and the lower shell 301, and the conductor 303 is located between the upper shell 300 and the lower shell 301. Each cavity of the upper shell 300 is provided with an excitation device 304 and a breaking device 305 successively. The breaking device 305 is provided with an impact head 306. Portions of the conductor 303 corresponding to the impact head 306 are provided with weak to-be-broken portions 310. A support device 311 is provided between the weak to-be-broken portions 310 to support the conductor 303, and a melt 307 is connected in parallel to two sides of the weak to-be-broken portion 310 of the conductor 303 closest to the impact head 306 of breaking device 305. The arc extinguishing shell 302 is provided therein with an arc extinguishing chamber filled with an arc extinguishing medium 308, and the weak to-be-fused portion of the melt 307 is arranged in the arc extinguishing medium. When the excitation device 304 is a gas generating device, a sealing member 309 is provided between the breaking device 103 and the inner wall of each shell, and the sealing member 309 is a sealing ring. The breaking device 103 can also be provided in the manner of interference fit.

In FIG. 8, the conductor 303 is broken by two sets of excitation devices 304 and breaking devices 305. The two sets of excitation devices 304 can receive excitation signals from the outside at the same time, and simultaneously drive the breaking devices 305 to break the conductor 303. In this case, when the distances between the conductor 303 and the impact heads 306 on the breaking devices 305 are the same, the impact heads 306 simultaneously create multiple fractures on the conductor 303; and when the distances between the conductor 303 and the impact heads 306 on the breaking devices 305 are different, the impact head 306 with the shortest distance to the conductor 303 firstly creates the fracture on the conductor 303, and in this case, the melt 307 is connected in parallel with the fracture formed first, and when there are three or more fractures, the fracture formed first can be in number of two or more, and the melt 307 can be connected in parallel with the multiple fractures formed simultaneously, but it must be ensured that at least one fracture is connected in series with the melt 307.

Two sets of excitation devices 102 may be provided to receive excitation signals successively, and drive, according to the sequence of receiving the excitation signals, the breaking device 305 to break the conductor 303, thereby forming multiple fractures successively. In the case where the breaking device 305 first creates one fracture on the conductor 303, the melt 307 is connected in parallel with the fracture formed first, and then connected in series with the fracture formed later. The fracture formed first can be in number of two or more, and the melt 307 can be connected in parallel with multiple fractures formed simultaneously, but it should be ensured that at least one fracture is connected in series with the melt 307.

The purpose that at least one fracture must be connected in series with the melt 307 above is to ensure that the circuit is disconnected when the fault current is relatively small and insufficient to fuse and break the melt 307, and at this time, the forming of the fracture connected in series with the melt 307 can ensure the disconnection of the circuit.

It can be seen from the above that successive forming of the fractures on the conductor 303 can be achieved through different distances between the conductor 303 and the impact heads 306 on the breaking device 305, or by the sequence of the excitation device 102 receiving the excitation signals.

The working principle of the arc extinguishing of the melt 307 is that the on-resistance of the conductor 303 differs from the resistivity of the melt 307 by one order, such that under normal conditions, almost all the current flows through the conductor 303, and there is a very small current passing through the melt 307.

After the conductor 303 is mechanically broken, the resistivity at the fracture of the conductor 303 instantly increases to result in almost blocking, at this time, most of the overcurrent energy flows through the melt 307, and a small part forms an arc discharge at the fracture, therefore, it will not cause fracture ablation and other phenomena at the fracture. Most of the overcurrent flowing through the melt 307 will not cause ablation or other effects on the fracture connected in series therewith, at this time, a partial pressure is formed by the melt 307 and the serial port connected in series, improving the voltage breaking capability. The arc generated at the fused fracture of the melt 307 is extinguished in the arc extinguishing medium, the arc at the serially-connected fracture is relatively small, and the arc is extinguished by air.

In the above-mentioned embodiment, the material of the melt 307 is metal or other conductive materials; the arc extinguishing medium may be materials for arc extinguishing, such as a gas, liquid, solid with arc extinguishing function. The impact head 306 of the breaking device 305 is in a planar structure, a contracted surface structure, or a pointed protruding structure and the like.

In the above-mentioned embodiment, the purpose of providing the weak to-be-broken portion of the conductor 303 is to reduce the mechanical strength of the conductor 303 at the fraction. The following measures can be selected or used at the same time, but not limited thereto, to weaken the strength at the fracture: a. reducing the stress section of the material, improving the stress concentration of the material, providing U-shaped groove(s), V-shaped groove(s), hole(s), hollow structure(s) and the like or their combination structures, wherein the weak to-be-broken portion can be provided on the section of the conductor 303 at any angle; b. achieving stress concentration at the fracture, by using a variable section structure to produce stress concentration in the transition zone, such as reserving gap, or using shear force; c. using low-strength conductor materials for the fracture, such as tin; and d. using mechanical force to compress tightly and/or fix prefabricated fracture and the like.

In the above-mentioned fuse structure, the contact surfaces between the shell and the shell, between the conductor 303 and the shell, between the arc extinguishing chamber and the shell, and between the melt 307 and the shell and the like are all sealed, preventing working safety of the fuse from being affected by reduction of driving force caused by the leakage of the high-pressure gas, arc leakage and other reasons.

Figure 9:
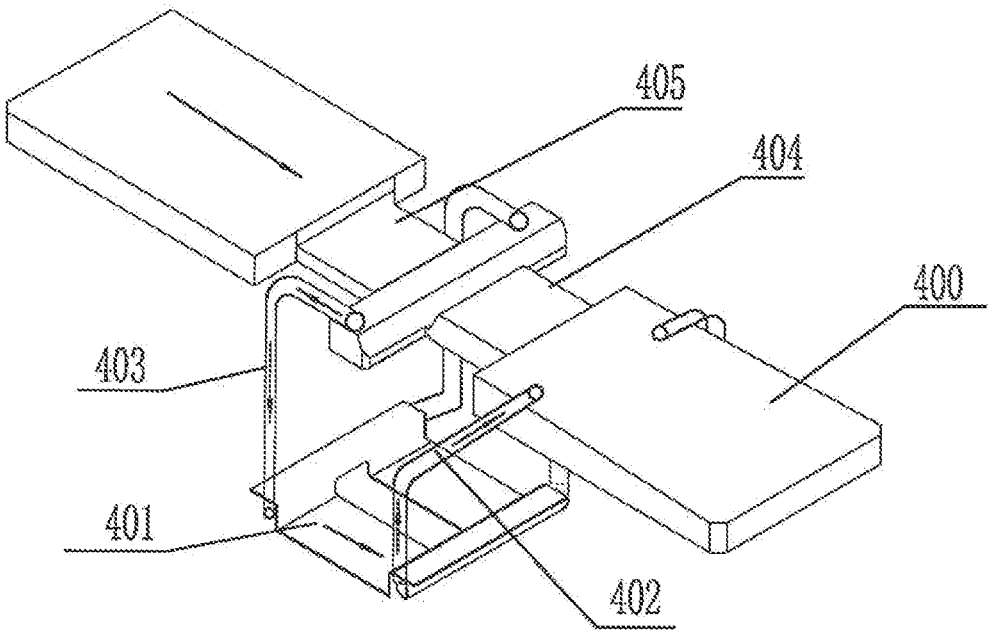
FIG. 9 is a structural schematic view showing connection of a melt with serially-connected fractures and parallelly-connected fractures generating magnetic force to extinguish arc.

In the above-mentioned embodiment, the melt 401 can also extend to the fractures connected in series with of the conductor 400, as shown in FIG. 9, the melt 401 is connected, through the connecting wire 402 and the connecting wire 403, in parallel with the weak to-be-broken portion 404 for forming a fracture on the conductor 303, and is connected in series with the weak to-be-broken portion 405 for forming a fracture on the conductor 303. The direction of the part of the current on the connecting wire 403 is opposite or perpendicular to the direction of the current of the conductor 303 at the position of the serially-connected fracture. According to the electromagnetic field theory, the magnetic force generated at the serially-connected fracture can elongate the arc generated at the serially-connected fracture to extinguish the arc. According to the theory of magnetic field being generated by current, position relationship between the melt 307 and the fractures of the conductor 303 is set in such a way of satisfying that the Loren magnetic force generated when the fracture is formed can extend the arc at the fracture, thereby the arc is cooled and the arc extinguishing capability of the serially-connected fracture is improved.

In the above-mentioned embodiment, multiple conductors 303 may also be connected in parallel in the shell, and two ends of each conductor 303 are respectively connected to the external circuit through conductive terminals. When the multiple conductors 303 are connected in parallel, the parallel-connected conductor 303 can broaden the range of breaking current, due to its shunt function.

The working principle of the present disclosure is illustrated by taking FIG. 1 to FIG. 4 as examples.

When no fault current is generated but the circuit needs to be disconnected under certain specific conditions, the conditions for conveying the excitation signal to the excitation device 102 can be set in the external control system in advance, wherein if the conditions are met, the excitation signal is conveyed to the excitation device 102, and the excitation device 102 receives the excitation signal and acts to ignite and detonate to release high-pressure gas, and drives the breaking device 103 to break the conductor successively. At this time, as the current flowing to the arc extinguishing melt 111 is not enough to fuse the arc extinguishing melt 111, the circuit is disconnected through the breaking device 103.

When the fault current is generated but the fault current is small, excitation device 102 receives the excitation signal from the outside to ignite and detonate the excitation device 102, causes the excitation device 102 to release high-pressure gas, and drives the breaking device 103 to break the limit mechanism and move downward to impact the conductor 101. Since there are multiple impact heads 106, 105 and the distance from the impact heads to the conductor are different, the impact head 105 nearest to the conductor will first break, when the breaking device 103 impacts the conductor 101, the corresponding weak to-be-broken portion 108 of the conductor, that is, performing breaking firstly at the position of the weak to-be-broken portion 108, at this time, the fault current is not enough to fuse and break the melt 111, wherein as the fault current is small, the arc generated at the fracture of the weak to-be-broken portion 108 is smaller, and the arc can be extinguished by air; after the weak to-be-broken portion 108 is broken, the breaking device 103 continues to move downward, and the impact head 106 with high height impacts the conductor 101 and breaks the corresponding the weak to-be-broken portion 107, so that the conductor 101 is broken for the second time, the two fractures formed on the conductor 101 and connected in series with the melt 111 completely disconnect the circuit, and due to the discharge of the overcurrent at the fracture connected in parallel with the melt 111, the current at the fracture connected in series with the melt 111 has become smaller, and the arc generated has already become very small, thus the arc can be extinguished by air.

When the fault current is generated and the fault current is large, the excitation device 102 is ignited and detonated, when the excitation device 102 receives the excitation signal from the outside, so that the excitation device 102 is made to release high-pressure gas, and drives the breaking device 103 to break the limit mechanism and move downward to impact the conductor 101. The conductor 101 is first broken at the weak to-be-broken portion 108, and at the moment of breaking, most of the current flows through the melt 111 connected in parallel therewith, therefore, the arc at the fracture of the weak to-be-broken portion 108 connected in parallel with the melt 111 is very small, and the arc can be easily extinguished by air; the melt 111 is fused and broken at the weak to-be-fused portion of the arc extinguishing medium, and the arc generated by the arc extinguishing medium is extinguished; at the same time, as the breaking device 103 continues to move, the conductor 101 is broken at the weak to-be-broken portion 107 and the second and third fractures connected in series with the melt 111 are generated, wherein due to the partial pressure of the melt 111, the partial pressure arc at the second and third factures is also very small, and the arc can be well extinguished by air.

When the fault current is generated and the fault current is very large, the melt 111 is fused to be broken first, and the large arc generated is extinguished in the arc extinguishing medium; at the same time, the weak to-be-broken portion 108 connected in parallel with melt 111 is broken to form the fracture. The fracture formed by the fusing of melt 111 discharges part of the overcurrent energy, and the arc generated at the fracture connected in parallel therewith is not enough to cause the damage to the fracture, and the arc can be extinguished by air, and then with the continuous movement of the breaking device 103, the second and third fractures are formed on the conductor 101, and the arc generated after the partial pressure becomes smaller and the arc is more easily extinguished.

In FIG. 1, when the several impact heads 105, 106 of the breaking device 103 are even, three fractures can be formed at the same time; when there is no fault current or the fault current is relatively small, the melt 111 will not be broken by fusing, and the multiple fractures can reduce the arc, such that the arc extinguishing can be ensured through air; when the fault current is large, the melt 111 will be also fused and broken while generating the multiple fractures, and the arc extinguishing medium participates in the arc extinguishing, which can quickly extinguish the arc and improve the arc extinguishing capability, and when the fault current is very large, the melt 111 will be fused to be broken and the arc extinguishing medium will participate in the arc extinguishing, wherein after the formation of the multiple fractures, the current will be completely cut off to extinguish the arc.

Similarly, the working principle of FIG. 8 is almost the same as that of FIG. 1, the only difference is that the excitation devices 304 can operate at the same time, or can operate or not according to the sequence of the excitation signals received by the excitation devices 304. For example, when there is no fault current, the excitation signal can be sent to only the excitation device 304 in the chamber without the melt 307, to activate the excitation device 304 to drive the breaking device 305 to break the conductor 303 to realize the circuit disconnection protection; whereas at the portion of the conductor 303 connected in parallel with the melt 307, the excitation device 304 and the breaking device 305 do not operate. When multiple fractures are required to be formed successively, the excitation signal can be sent to the excitation device 304 that needs to perform breaking first, and then the excitation signal can be sent in delay to the excitation device 304 that needs to perform breaking later, so as to achieve the purpose of sequential breaking.

Comparing with the traditional excitation fuse, the excitation fuse of the present disclosure has the following advantages.

1. The conductor can be broken through multiple fractures to improve the reliability of the breaking.

2. The melt can protect the parallelly-connected fracture and reduce the arc energy passing through the parallelly-connected fracture, which facilitates the rapid recovery of the strength of the insulating medium thereof, rapid breaking when the low rated current passes, and realizing safe recovery of insulation under large current breaking and of parallelly-connected fracture.

3. By providing the serially-connected fracture, the problems are alleviated that the small-amplitude overcurrent caused by the melt mode cannot be broken if it is lower than the rated current of the fuse, or the amplitude is not large enough, the breaking time of the fuse is too long; and 4. By setting the forming sequence of different fractures, it can be adjusted according to the needs to use separate mechanical breaking or mechanical and melt fusing combined method to perform breaking, which meets the needs of circuit protection in various occasions.

It can be seen from the above that the fuse of the present disclosure can be excited by different excitation devices according to the sequence of receiving the excitation signals, so that the breaking device is driven to form the fractures on the conductor successively; or by the different heights of the impact heads of the breaking device, several successively delayed fractures are formed on the conductor to achieve multiple arc extinguishing and improve the arc extinguishing capability; at the same time, the range of the breaking current is broadened, and the full current range breaking is realized, and the breaking capability is improved; and the fracture formed by breaking in delay can ensure the physical breaking of the conductor, which improves the reliability of the fuse and makes the performance of the fuse more excellent.

INDUSTRIAL APPLICABILITY

The fuse of the present disclosure can be excited by different excitation devices according to the sequence of receiving the excitation signal, and the breaking device is driven to form the fractures on the conductor successively; or by using the different heights of the impact heads of the breaking device, several successively delayed fractures are formed on the conductor to achieve multiple arc extinguishing and improve the arc extinguishing capability; at the same time, the range of the breaking current is broadened, and the full current range breaking is realized, and the breaking capability is improved; and the fracture formed by breaking in delay can ensure the physical breaking of the conductor, which improves the reliability of the fuse and makes the performance of the fuse more excellent.

What is claimed is:

1. A mechanical breaking and fusing combined multi-fracture excitation fuse, comprising:

a shell, wherein at least one cavity is provided in the shell, and at least one conductor penetrates through the shell and penetrates through the cavity;

at least one excitation device and at least one breaking device are arranged in the cavity of the shell;

the excitation device is configured to receive an external excitation signal to drive the breaking device to act to break a section of the at least one conductor corresponding thereto to form at least two fractures at respective fracture points on the section of the at least one conductor, at least one melting portion is connected in parallel onto the conductor, the at least one melting portion is connected in parallel with at least one fracture point, and the at least one melting portion is connected in series with at least one fracture point.

2. The mechanical breaking and fusing combined multi-fracture excitation fuse according to claim 1, wherein an arc extinguishing chamber filled with an arc extinguishing medium is provided in the shell; and the at least one melting portion is inserted in the arc extinguishing chamber with a part or whole of the at least one melting portion located in the arc extinguishing chamber, a fused fracture point of the at least one melting portion is located in the arc extinguishing chamber.

3. The mechanical breaking and fusing combined multi-fracture excitation fuse according to claim 1, wherein a weak to-be-broken portion connected in parallel with the at least one melting portion is broken first, and a weak to-be-broken portion connected in series with the at least one melting portion is broken afterwards.

4. The mechanical breaking and fusing combined multi-fracture excitation fuse according to claim 1, wherein at least two adjacent cavities are formed in the shell, the conductor penetrates through the shell and penetrates through the adjacent cavities, each of the cavities at one side of the conductor is provided with one excitation device and one breaking device, the excitation devices and the breaking devices in the different cavities are located at a same side or different sides of the conductor, each of the breaking devices is provided with at least one impact head, and the excitation device is configured for receiving an external excitation signal to drive the corresponding breaking device to break the conductor to form at least one fracture point.

5. The mechanical breaking and fusing combined multi-fracture excitation fuse according to claim 1, wherein at least two impact heads are arranged on the breaking device at intervals, and each impact head is configured to form at least one fracture point on the conductor.

6. The mechanical breaking and fusing combined multi-fracture excitation fuse according to claim 5, wherein distances between the conductor and the impact heads are different, the impact head with the shortest distance to the conductor is configured to first create the fracture point on the conductor first, and the at least one melting portion is configured to be connected in parallel at the fracture point that is formed first.

7. The mechanical breaking and fusing combined multi-fracture excitation fuse according to claim 1, wherein the excitation device is a gas generating device, the breaking device is a piston, and contact between surfaces of the breaking device and the cavity is sealed contact or contact with a gap of less than 0.1 mm.

8. The mechanical breaking and fusing combined multi-fracture excitation fuse according to claim 1, wherein a limiting structure configured for maintaining the breaking device at an initial position is arranged between the breaking device and the cavity.

9. The mechanical breaking and fusing combined multi-fracture excitation fuse according to claim 1, wherein a portion of the conductor corresponding to the breaking device is provided with a weak to-be-broken portion that reduces a strength of the conductor, and the fracture point is formed by breaking at the weak to-be-broken portion.

10. The mechanical breaking and fusing combined multi-fracture excitation fuse according to claim 9, wherein the weak to-be-broken portion is a reduced section structure provided at the conductor, a structure of increasing a stress at the fracture point of the conductor, and/or a material with low mechanical strength used at the fracture point of the conductor.

11. The mechanical breaking and fusing combined multi-fracture excitation fuse according to claim 10, wherein the reduced section structure is one of a gap provided at one side or two sides of the conductor, a U-shaped groove or a V-shaped groove which is provided at one side or two sides of the conductor and crosses a width of the conductor, and a hole provided at the conductor, or combination of more of them.

12. The mechanical breaking and fusing combined multi-fracture excitation fuse according to claim 1, wherein the at least one melting portion is provided with a weak to-be-fused portion, and the at least one melting portion is configured to be fused and broken at the weak to-be-fused portion.

13. The mechanical breaking and fusing combined multi-fracture excitation fuse according to claim 12, wherein the weak to-be-fused portion is a variable section structure or a narrow path provided at the at least one melting portion, and/or a conductor material capable of being melted at a low temperature and/or a conductor material with different conductivity used at the at least one melting portion.

14. The mechanical breaking and fusing combined multi-fracture excitation fuse according to claim 1, wherein a portion of the at least one melting portion connected with the conductor is spatially arranged around the serially-connected fracture point and connected to the parallelly-connected fracture point, wherein an electromagnetic field generated when current flows through the at least one melting portion and the connected conductor interacts with an arc at the fracture point, such that an arc path obtained after forming of the fracture of the conductor is elongated by the electromagnetic field.

15. The mechanical breaking and fusing combined multi-fracture excitation fuse according to claim 4, wherein an impact end of the impact head is in a constricted surface structure, a pointed protruding structure, an inclined surface structure or a concave structure having two sides being tips.

16. The mechanical breaking and fusing combined multi-fracture excitation fuse according to claim 5, wherein an impact end of the impact head is in a constricted surface structure, a pointed protruding structure, an inclined surface structure or a concave structure having two sides being tips.

17. The mechanical breaking and fusing combined multi-fracture excitation fuse according to claim 9, wherein a support device is arranged between the weak to-be-broken portions.

18. The mechanical breaking and fusing combined multi-fracture excitation fuse according to claim 2, wherein at least two adjacent cavities are formed in the shell, the conductor penetrates through the shell and penetrates through the adjacent cavities, each of the cavities at one side of the conductor is provided with one excitation device and one breaking device, the excitation devices and the breaking devices in the different cavities are located at a same side or different sides of the conductor, each of the breaking devices is provided with at least one impact head, and the excitation device is configured for receiving an external excitation signal to drive the corresponding breaking device to break the conductor to form at least one fracture point.

19. The mechanical breaking and fusing combined multi-fracture excitation fuse according to claim 3, wherein at least two adjacent cavities are formed in the shell, the conductor penetrates through the shell and penetrates through the adjacent cavities, each of the cavities at one side of the conductor is provided with one excitation device and one breaking device, the excitation devices and the breaking devices in the different cavities are located at a same side or different sides of the conductor, each of the breaking devices is provided with at least one impact head, and the excitation device is configured for receiving an external excitation signal to drive the corresponding breaking device to break the conductor to form at least one fracture point.

20. The mechanical breaking and fusing combined multi-fracture excitation fuse according to claim 2, wherein at least two impact heads are arranged on the breaking device at intervals, and each impact head is configured to form at least one fracture point on the conductor.

* * * * *